US008387299B1

(12) United States Patent
Brittingham et al.

(10) Patent No.: US 8,387,299 B1
(45) Date of Patent: Mar. 5, 2013

(54) RECOIL BOOSTER FOR FIREARM SOUND SUPPRESSORS

(75) Inventors: Kevin T. Brittingham, Dacula, GA (US); Michael Leighton Smith, Alpharetta, GA (US); Hunter Martin Terhune, Snellville, GA (US)

(73) Assignee: Advanced Armament Corp., LLC, Madison, NC (US)

( * ) Notice: Subject to any disclaimer, the term of this patent is extended or adjusted under 35 U.S.C. 154(b) by 291 days.

(21) Appl. No.: 12/854,110

(22) Filed: Aug. 10, 2010

(51) Int. Cl.
*F41A 21/30* (2006.01)
*F41A 21/32* (2006.01)

(52) U.S. Cl. ..... 42/90; 42/14.4; 42/14.5

(58) Field of Classification Search ..... 42/90; 89/14.4, 89/14.5; 181/223
See application file for complete search history.

(56) References Cited

U.S. PATENT DOCUMENTS

| | | | | |
|---|---|---|---|---|
| 7,588,122 | B2 * | 9/2009 | Brittingham | 181/223 |
| 7,594,464 | B2 | 9/2009 | Dueck | |
| 7,891,282 | B1 * | 2/2011 | DeGroat | 89/14.4 |
| 7,905,171 | B1 * | 3/2011 | Brittingham | 89/36.08 |
| 8,091,462 | B2 * | 1/2012 | Dueck et al. | 89/14.05 |
| 8,162,100 | B2 * | 4/2012 | Shults et al. | 181/223 |
| 2009/0050403 | A1 * | 2/2009 | Brittingham | 181/223 |
| 2011/0036233 | A1 * | 2/2011 | DeGroat | 89/14.4 |
| 2011/0061966 | A1 * | 3/2011 | Brittingham | 181/223 |
| 2011/0088540 | A1 * | 4/2011 | Brittingham et al. | 89/14.5 |

* cited by examiner

*Primary Examiner* — Bret Hayes
*Assistant Examiner* — Joshua Freeman
(74) *Attorney, Agent, or Firm* — Womble Carlyle Sandridge & Rice, LLP

(57) ABSTRACT

A recoil booster for use with a sound suppressor for a firearm includes a hollow piston configured to be coupled to the firearm, a cap assembly, and a housing configured to be coupled to the sound suppressor. The cap assembly is removably coupled to the housing and includes an inner periphery configured to slidably guide a head portion of the piston. The housing includes an internal shoulder configured to abut the head portion of the piston in a nominal position of the booster. When the cap assembly is uncoupled from the housing, the piston is removable from the booster by sliding the head portion of the piston forward out of the cap assembly.

17 Claims, 6 Drawing Sheets

RECOIL BOOSTER FOR FIREARM SOUND SUPPRESSORS

TECHNICAL FIELD

This invention generally relates to firearm sound suppressors and more particularly to a recoil booster for use in a firearm sound suppressor.

BACKGROUND

It is known that firearm sound suppressors or "silencers" reduce or modify the amount of recoil or kickback and the sound level of a muzzle blast (caused by the discharge of pressurized burning gases from the firearm). However, in many conventional firearms such as auto-loading handguns, the barrel of the firearm must freely tilt to permit extraction and ejection of a projectile casing, thereby enabling the cycling of the action and automatic reloading of a new round into the firing chamber. Firearm sound suppressors for centerfire pistols typically add too much weight to the barrel to allow normal recoiling and tilting of the barrel to work the automatic reloading action. As a result, conventional firearm sound suppressors have included recoil boosters (hereinafter "boosters") that increase the amount of recoil acting on the barrel of the firearm by temporarily decoupling the weight of the sound suppressor from the barrel.

One example of a prior booster is disclosed in U.S. Pat. No. 7,588,122 to Brittingham, the disclosure of which is hereby incorporated by reference in its entirety. This prior booster includes an elongate piston threadably coupled to a firearm barrel and a housing coupled with a sound suppressor and disposed coaxially about the piston. The piston includes a head portion with a plurality of spokes about a periphery, the spokes configured to slide closely along the inner periphery of the housing and abut an end wall of the housing in a rest or nominal state of the booster. A spring disposed around the piston biases the head portion into abutting engagement with the forward end wall of the housing in the nominal state. In operation, the pressurized gases released during discharge of the firearm would force the sound suppressor and the housing forward such that the piston head slides relatively rearward along the inner periphery of the housing against the bias of the spring, thereby temporarily decoupling the weight of the sound suppressor from the firearm barrel.

When the prior booster is to be disassembled for cleaning or for changing to a new piston, the piston head and the corresponding spokes must be dragged along the entire length of the inner periphery of the housing in the booster. As the firearm is discharged numerous times, discharged powder and other particulate matter forms a soot-like deposit along various surfaces of the sound suppressor. The deposits may build up enough along the inner periphery of the housing such that sliding the piston head through the full length of the housing becomes difficult or impossible. Furthermore, the piston head is being pulled against the bias of the spring, which further increases the difficulty of disassembly, or, if the spring is removed, provides no assistance in removal of the piston.

Therefore, it would be desirable to improve the booster used in a firearm sound suppressor and address some of the problems with conventional boosters.

SUMMARY OF THE INVENTION

According to one embodiment of the present invention, a booster for use with a sound suppressor for a firearm includes a hollow piston having a head portion at a forward end defining a first outer periphery. The hollow piston also includes an elongate generally cylindrical portion rearward of the head portion and defining a second outer periphery. The piston is configured to be coupled to a barrel of the firearm. The booster also includes a cap assembly having a forward portion and a rear portion. The forward portion has a first inner periphery configured to slidably guide the first outer periphery of the head portion of the piston and also configured to be spaced from the second outer periphery of the cylindrical portion of the piston to define an annular space between the piston and the cap assembly. The rear portion has a second inner periphery configured to slidably engage the second outer periphery of the cylindrical portion of the piston.

The booster includes a spring disposed in the annular space between the head portion of the piston and a rear portion of the cap assembly. The spring biases the head portion of the piston away from the rear portion of the cap assembly. The booster also includes a housing coupled to the sound suppressor and removably coupled to the cap assembly. The housing includes an internal shoulder configured to abut the head portion of the piston in a nominal position of the booster. When the cap assembly is uncoupled from the housing, the piston may be removed from the booster by sliding the piston forward out of the forward portion of the cap assembly. In this regard, the piston does not have to be slid along the complete first inner periphery of the cap assembly during disassembly of the booster.

The head portion of the piston may include a plurality of spokes defining the first outer periphery. The internal shoulder of the housing includes a plurality of slots configured to receive the plurality of spokes when the head portion of the piston abuts the internal shoulder. The housing may also include a first plurality of radial apertures in communication with the plurality of slots. The radial apertures enable the head portion to force out any debris that may lodge in the plurality of slots away from the slots.

The housing may further include a forward wall defining the internal shoulder and a generally cylindrical outer housing extending rearward from the forward wall. The outer housing includes external threads configured to couple to the cap assembly adjacent to the rear portion of the cap assembly. The forward portion of the cap assembly may include an inner housing extending coaxial with the outer housing and from the rear portion of the cap assembly toward the forward wall of the housing. A first annular chamber is defined between the inner housing and the outer housing. The inner housing of the cap assembly includes a plurality of apertures providing fluid communication between the annular space and the first annular chamber. The outer housing may include external threads configured to couple to an outer tube of the sound suppressor such that a second annular chamber is defined between the outer tube and the outer housing. The outer housing includes a second plurality of radial apertures providing fluid communication between the first annular chamber and the second annular chamber. Thus, the booster is configured to enable redirection of pressurized air released with the discharge of the firearm.

BRIEF DESCRIPTION OF THE DRAWINGS

The accompanying drawings, which are incorporated in and constitute a part of this specification, illustrate an embodiment of the invention and, together with a general description of the invention given below, serve to explain the principles of the invention. Like reference numerals are used to indicate like parts throughout the various figures of the drawing, wherein.

DETAILED DESCRIPTION

Figure 1:
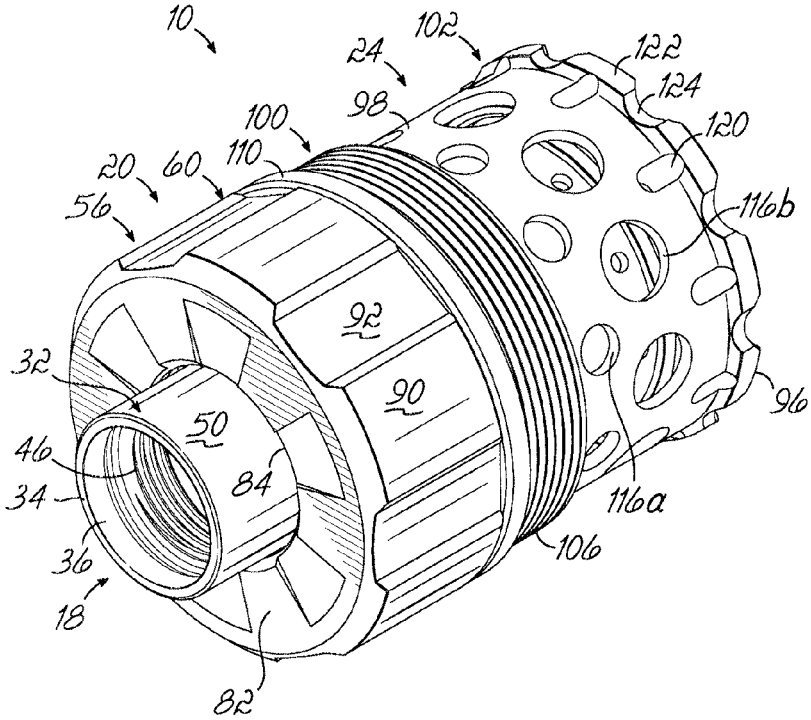
FIG. 1 is a pictorial view of a first embodiment of a booster module (hereinafter "booster") for a firearm sound suppressor in a fully assembled state.

Referring to FIGS. 1-5, a first embodiment of a booster 10 for use in a firearm sound suppressor 12 is illustrated. The booster 10 is configured to temporarily decouple the weight of the sound suppressor 12 from a barrel 14 of a firearm 16. The booster 10 includes a hollow piston 18 configured to be coupled to the barrel 14, a cap assembly 20, a spring 22 disposed between the piston 18 and the cap assembly 20, and a housing 24 coupled to the sound suppressor 12. In a rest or nominal position of the booster 10, the spring 22 biases the piston 18 toward an internal shoulder 26 on the housing 24. The piston 18 is configured to slide within the cap assembly 20 against the bias of the spring 22 when the firearm 16 is discharged, thereby enabling the sound suppressor 12 (coupled to the housing 24) to temporarily move with respect to the barrel 14 of the firearm 16.

Figure 3:
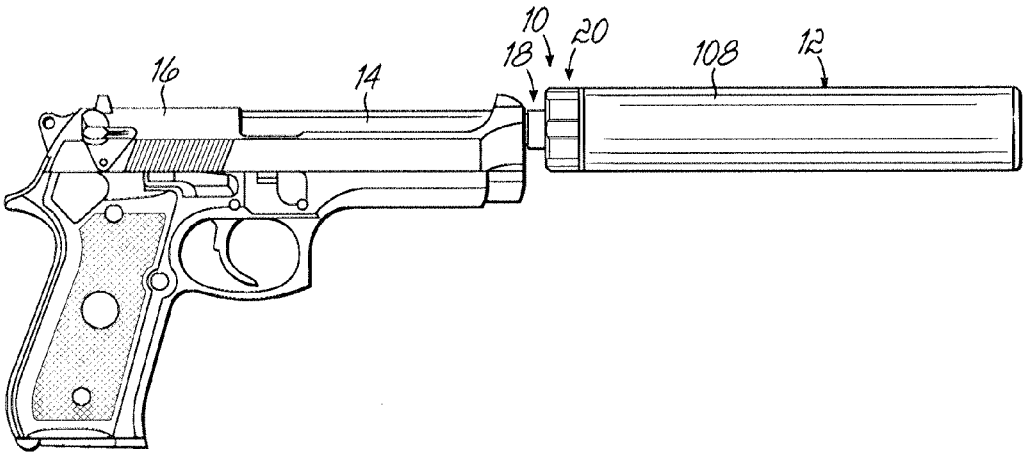
FIG. 3 is a side elevation view of the booster of FIG. 1 incorporated with a sound suppressor and a firearm.
Figure 2:
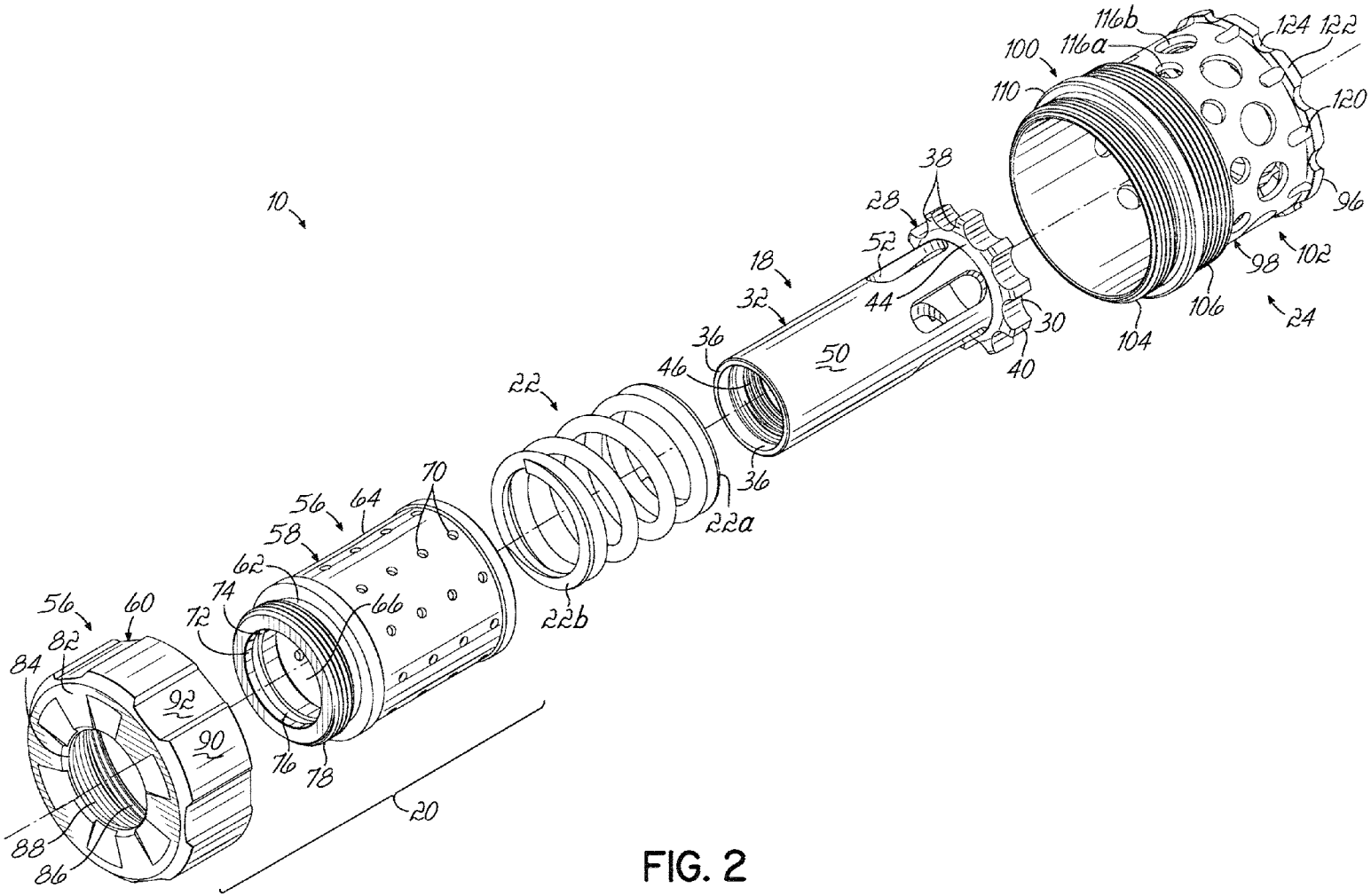
FIG. 2 is a pictorial view of the booster of FIG. 1 in an exploded or disassembled state.
Figure 4:
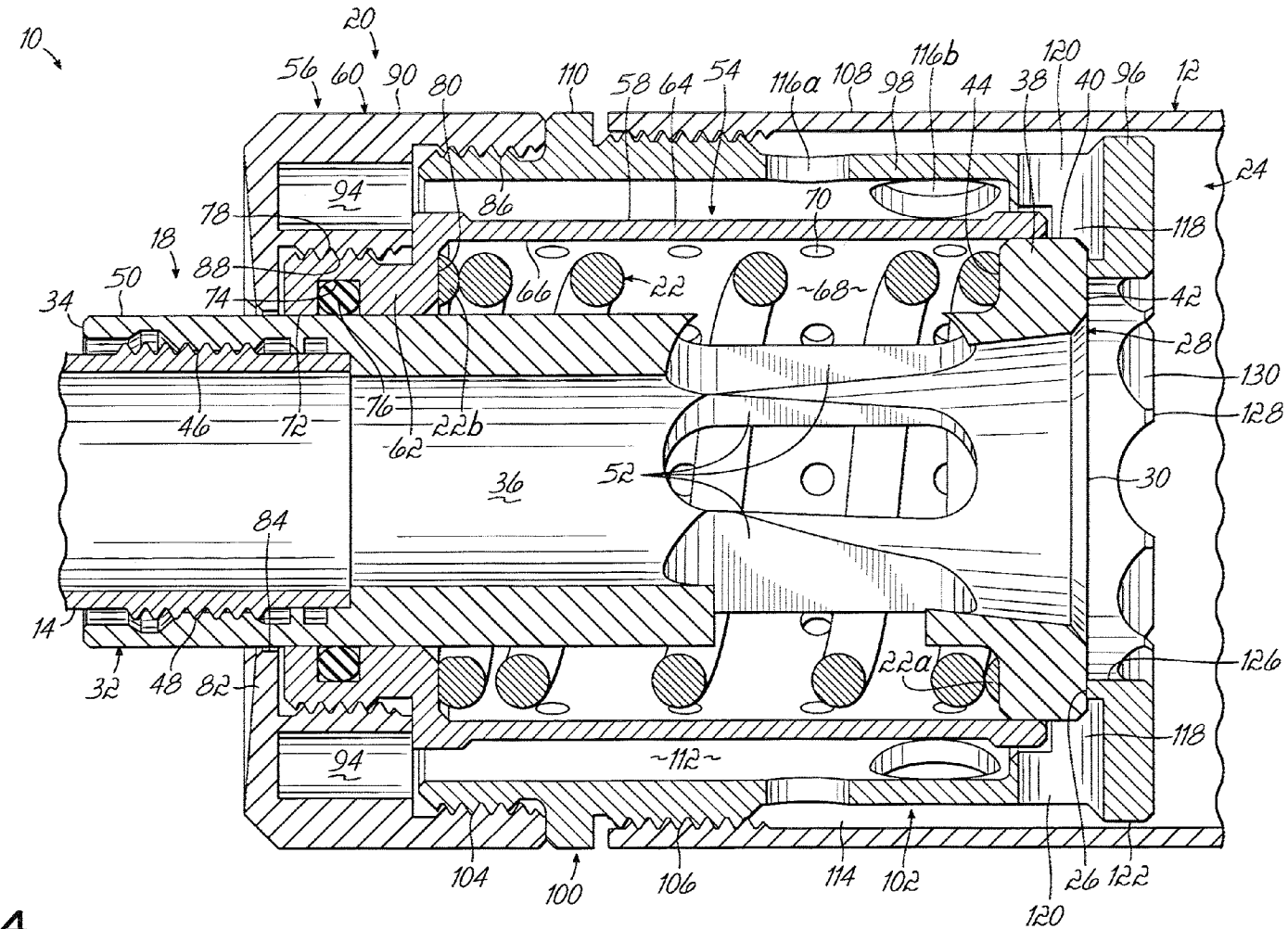
FIG. 4 is a longitudinal sectional side view of the booster of FIG. 3 in a nominal position.

As shown most clearly in FIGS. 2-4, the piston 18 includes a head portion 28 at a forward end 30 and an elongate generally cylindrical portion 32 extending rearward from the head portion 28 to a rear end 34. The piston 18 includes a central bore 36 extending through the head portion 28 and the cylindrical portion 32. The central bore 36 is sized to permit a fired projectile from the barrel 14 to pass through the booster 10 unimpeded. The head portion 28 further includes a plurality of spokes 38 flaring radially outwardly to define a first outer periphery 40 of the piston 18. The plurality of spokes 38 also define a seating surface 42 facing forward at the forward end 30 and a first spring retaining surface 44 facing rearward. The cylindrical portion 32 of the piston 18 includes internal threads 46 at the central bore 36 adjacent the rear end 34 of the piston 18, the internal threads 46 configured to engage with corresponding external threads 48 on the barrel 14 of the firearm 16. The cylindrical portion 32 also defines a second outer periphery 50 with a smaller diameter than the first outer periphery 40 at the head portion 28. A plurality of elongate slots 52 is disposed through the cylindrical portion 32 just rear of the head portion 28. The elongate slots 52 are angled slightly from a radial direction such that pressurized gases released during discharge of the firearm 16 are directed to apply a force rotationally on the piston 18 that tends to tighten the piston 18 on the barrel 14. It will be understood that the slots 52 may be angled either direction depending upon the left-handed or right-handed nature of the internal threads 46.

It will be appreciated that the piston 18 is removable from the booster 10 for a number of reasons. As described in detail above, the piston 18 may be removed temporarily for cleaning of the booster 10 of all soot-like debris or deposits. A consumer may also remove the piston 18 and replace it with another piston having different internal threads 46 such that the sound suppressor 12 may be used with a firearm barrel 16 having corresponding external threads 48 different from the first-described firearm 14. A manufacturer may also remove the piston 18 and replace it with another piston 18 having a different caliber central bore 36. Advantageously, the remaining elements of the booster 10 remain the same size for different caliber pistons 18, thereby enabling a manufacturer to make a booster 10 for many different caliber weapons by just providing a different piston 18 in the booster 10.

The cap assembly 20 includes a forward portion 54 and a rear portion 56 collectively defined by a first cap member 58 and a second cap member 60. The first cap member 58 includes a hub 62 at the rear portion 56 and an inner housing 64 at the forward portion 54. The inner housing 64 is generally a hollow cylinder having a first inner periphery 66. The first inner periphery 66 generally corresponds in size to the first outer periphery 40 of the head portion 28 of the piston 18 such that the head portion 28 is slidably guided along the first inner periphery 66. The first inner periphery 66 is also spaced from the second outer periphery 50 of the cylindrical portion 32 of the piston 18 to define an annular space 68 between the piston 18 and the inner housing 64. The inner housing 64 also includes a plurality of apertures 70 providing fluid communication with the annular space 68.

The hub 62 is also hollow and includes a second inner periphery 72 generally corresponding in size to the second outer periphery 50 of the piston 18. The cylindrical portion 32 of the piston 18 is therefore slidably engaged with the second inner periphery 72. The hub 62 also includes a groove 74 at the second inner periphery 72 for receiving an O-ring 76. The O-ring 76 seals the annular space 68 from the outside environment surrounding the booster 10. The hub 62 further includes external threads 78 opposing the second inner periphery 72 for coupling to the second cap member 60 as described in further detail below. The hub 62 also includes a second spring retaining surface 80 facing forwardly and toward the annular space 68 and the first spring retaining surface 44.

The second cap member 60 includes a rear wall 82 including a rear wall aperture 84 sized to closely receive the cylindrical portion 32 of the piston 18. The second cap member 60 also includes first internal threads 86 and second internal threads 88. The second internal threads 88 are disposed immediately forward of the rear wall 82 and are configured to engage the external threads 78 on the hub 62 of the first cap member 58. The first internal threads 86 are disposed forward of the second internal threads 88 and are radially spaced from the inner housing 64. The second cap member 60 also includes a generally cylindrical outer surface 90 including a plurality of shallow grooves 92. In this regard, the outer surface 90 of the second cap member 60 is contoured for enhanced gripping. Between the generally cylindrical outer surface 90 and the second internal threads 88, the second cap member 60 further includes a circular series of bores 94 cut longitudinally toward the rear wall 82. The purpose of the circular series of bores 94 will be provided in more detail below. It will be appreciated that the cap assembly 20 could alternatively be formed as an integral piece rather than having the first cap member 58 and the second cap member 60 threadably joined, without departing from the scope of this invention. Furthermore, the cap assembly 20 generally remains together at all times after assembly of the first cap member 58 and the second cap member 60, although it is feasible to unthread these members 58, 60 from each other.

The housing 24 includes a forward wall 96 and a generally cylindrical outer housing 98 extending rearward from the forward wall 96. The outer housing 98 includes a rear portion 100 and a forward portion 102 disposed between the rear portion 100 and the forward wall 96. The rear portion 100 includes first external threads 104 configured to engage the first internal threads 86 of the second cap member 60 to thereby removably couple the cap assembly 20 and the housing 24 adjacent to the rear portion 56 of the cap assembly 20. Forward of the first external threads 104, the rear portion 100 also include second external threads 106 configured to couple with an internally threaded outer tube 108 of the sound suppressor 12. It will be understood that the functional aspects of the housing 24 could be formed integrally with the sound suppressor 12 in other embodiments consistent with the invention. The rear portion 100 further includes an annular projection 110 between the first external threads 106 and the second internal threads 108. The second cap member 60 and the outer tube 108 of the sound suppressor 12 are configured to abut opposing sides of the annular projection 110 when the booster 10 is fully assembled as shown in FIGS. 1 and 4.

The forward portion 102 of the outer housing 98 is disposed between and spaced from each of the inner housing 64 of the first cap member 58 and the outer tube 108 of the sound suppressor 12 when the booster 10 is fully assembled. Thus, the outer housing 98 and the inner housing 64 collectively define a first annular chamber 112 there between. The first annular chamber 112 extends longitudinally from the circular series of bores 94 in the second cap member 60 to the forward wall 96. Also, the outer housing 98 and the outer tube 108 of the sound suppressor 12 collectively define a second annular chamber 114 there between. The first annular chamber 112 is in fluid communication with the annular space 68 through the plurality of apertures 70 in the inner housing 64. Similarly, the second annular chamber 114 and the first annular chamber 112 are in fluid communication through a second plurality of radial apertures 116 in the forward portion 102 of the outer housing 98. The second plurality of radial apertures 116 includes a first circular series of small apertures 116*a* and a second circular series of large apertures 116*b* disposed forward of the first circular series of small apertures 116*a*. The large apertures 116*b* are larger in diameter than the small apertures 116*a*, but one of ordinary skill will understand that the apertures 116 could be formed with any suitable diameter.

The forward wall 96 includes the internal shoulder 26 configured to abut the head portion 28 of the piston 18 when the booster 10 is in the nominal or rest position shown in FIG. 4. The internal shoulder 26 includes a plurality of grooves 118 configured to engage the plurality of spokes 38 of the head portion 28 of the piston 18. The engagement of the spokes 38 and grooves 118 prevents relative rotation of the piston 18 and the housing 24 unless the piston 18 is pulled rearwardly away from the nominal position of FIG. 4. Consequently, the orientation of the housing 24 and a connected sound suppressor 12 with respect to the piston 18 and the corresponding firearm barrel 14 may be set by rotating the spokes 38 to engage with different grooves 118, as is well understood in the art. The forward wall 96 further includes a first plurality of radial apertures 120 corresponding in location to the plurality of grooves 118 in the internal shoulder 26. The radial apertures 120 permit flow of pressurized gases and debris outwardly toward the second annular chamber 114 when the head portion 28 of the piston 18 is pulled rearward from the abutting relationship with the internal shoulder 26. Consequently, any debris or residue that may block one of the spokes 38 from cleanly abutting the respective groove 118 can be forced out through the radial apertures 120. In the illustrated embodiment, the first plurality of radial apertures 120 is disposed immediately forward of the second plurality of radial apertures 116 in the outer housing 98 described above.

The forward wall 96 flares radially outwardly slightly forward of the first plurality of radial apertures 120 to define an outer periphery 122 configured to abut the outer tube 108 of the sound suppressor 12. The outer periphery 122 includes a plurality of longitudinal grooves 124 configured to enable fluid movement between the second annular chamber 114 and a space within the sound suppressor 12 forward of the booster 10. The forward wall 96 also includes a bore 126 extending from the internal shoulder 26 to a forward end surface 128. The bore 126 is configured to be a continuation of the central bore 36 through the piston 18. The forward end surface 128 also includes a plurality of radial grooves 130 generally disposed at the same locations as the longitudinal grooves 124 through the outer periphery 122. The radial grooves 130 further encourage flow of pressurized gases around the forward wall 96 from the bore 126 to the longitudinal grooves 124 and the second annular chamber 114.

The spring 22 is disposed within the annular space 68 as shown in FIGS. 3 and 4. The spring 22 includes a forward end 22*a* seated against the first spring retaining surface 44 at the head portion 28 of the piston 18, and a rear end 22*b* seated against the second spring retaining surface 80 of the hub 62 of the first cap member 58. The spring 22 is a compression spring configured to bias the head portion 28 of the piston 18 forwardly into abutting engagement with the internal shoulder 26 of the forward wall 96, as shown in the nominal or rest position of FIG. 4. When the firearm 16 is discharged in operation, the pressurized gases following the fired projectile travel through the booster 10 and the sound suppressor 12 while the firearm 16 recoils from the force of the discharge. This recoiling force pulls the barrel 14 and the piston 18 backwards against the bias of the spring 22 toward the discharge position shown in FIG. 5. Although the spring 22 is shown totally compressed in FIG. 5, it will be understood that the spring 22 may only partially compress depending upon the firearm 16. When the spring 22 is fully compressed, the elongate slots 52 in the cylindrical portion 32 of the piston 18 are still disposed within the forward portion 54 of the cap assembly 20, such that the annular space 68 is still sealed by the O-ring 76 from the space outside the booster 10.

Figure 5:
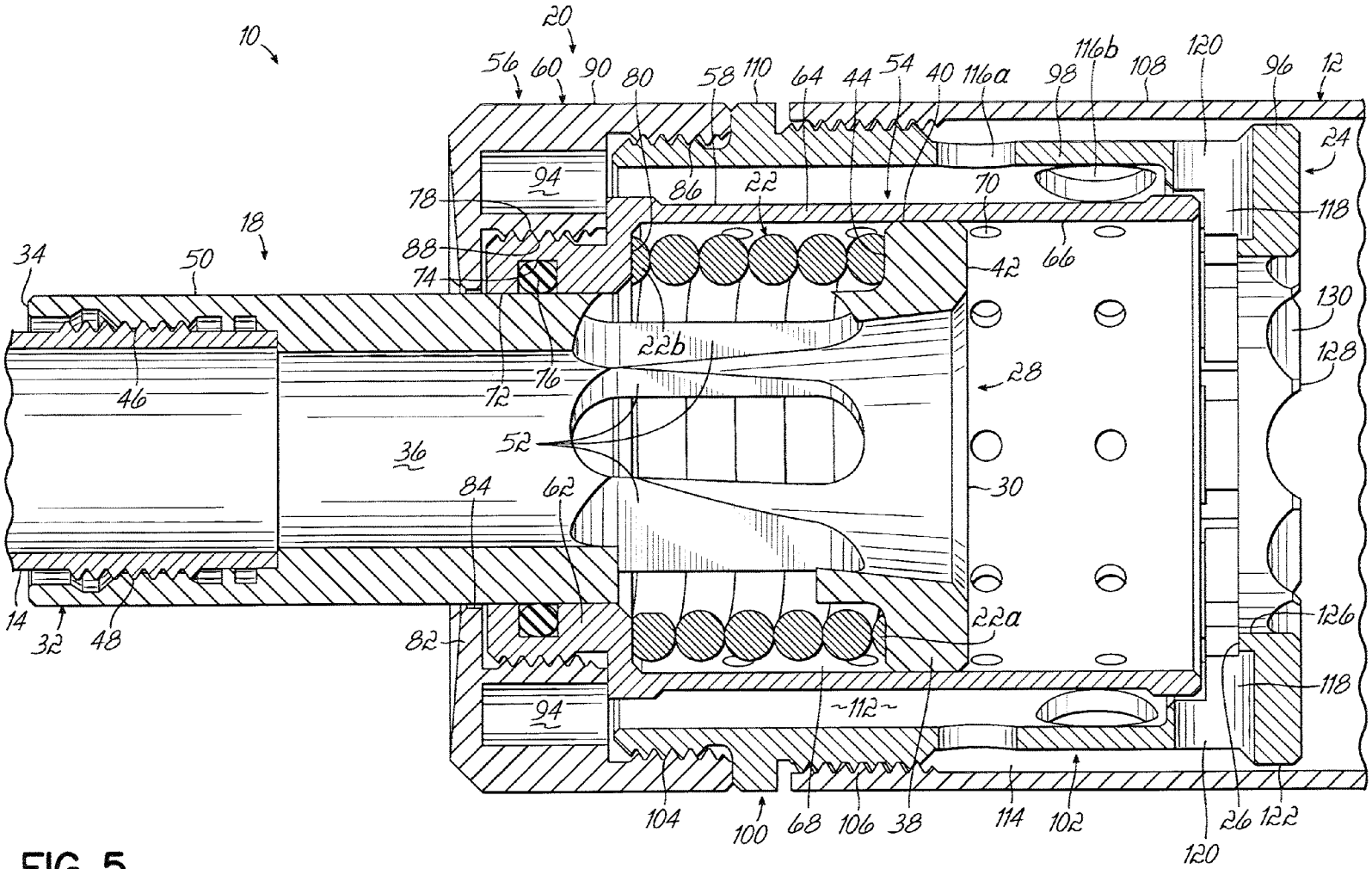
FIG. 5 is a longitudinal sectional side view of the booster of FIG. 3 in a discharge position.

As illustrated most clearly in FIGS. 4 and 5, the booster 10 provides a plurality of chambers and spaces configured to enable expansion and develop turbulent flow of the pressurized gases traveling through the booster 10 and the sound suppressor 12. Pressurized gases can flow from the central bore 26 of the piston 18 through the elongate slots 52 into the annular space 68, further through the plurality of apertures 70 in the inner housing 64 to the first annular chamber 112 and the circular series of bores 94, further through the second plurality of radial apertures 116 in the outer housing 98 to the second annular chamber 114, and further still through the longitudinal grooves 124 and radial grooves 130 in the forward wall 96 back towards the central bore 26. It will be understood that flow of pressurized gases may flow in the opposite direction or in a combination of directions, as well as through the first plurality of radial apertures 120 in the forward wall 96. The booster 10 therefore does not have a detrimental effect on the sound suppressing qualities of the sound suppressor 12.

Figure 6:
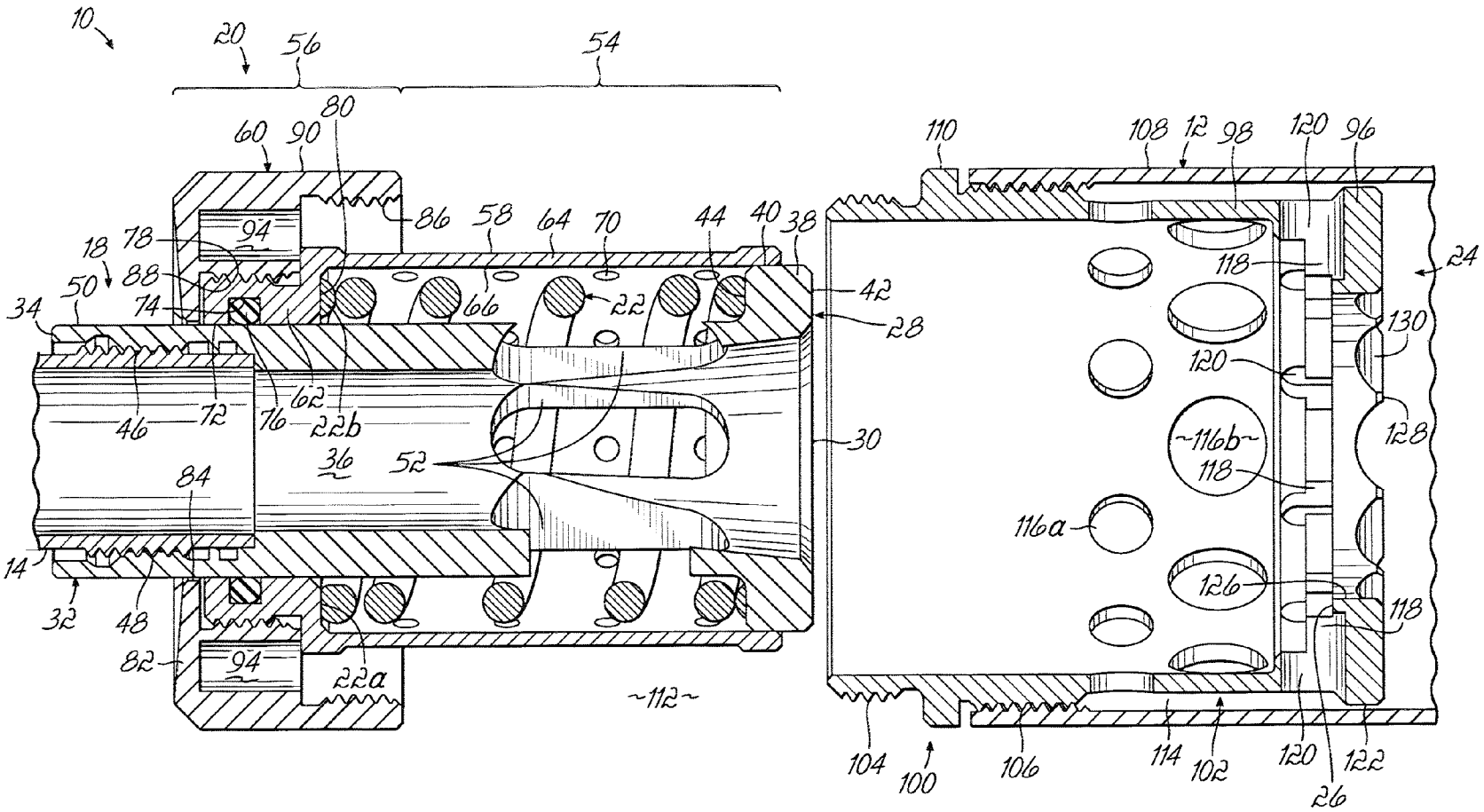
FIG. 6 is a longitudinal side view of the booster of FIG. 3 in a disconnected configuration.
Figure 7:
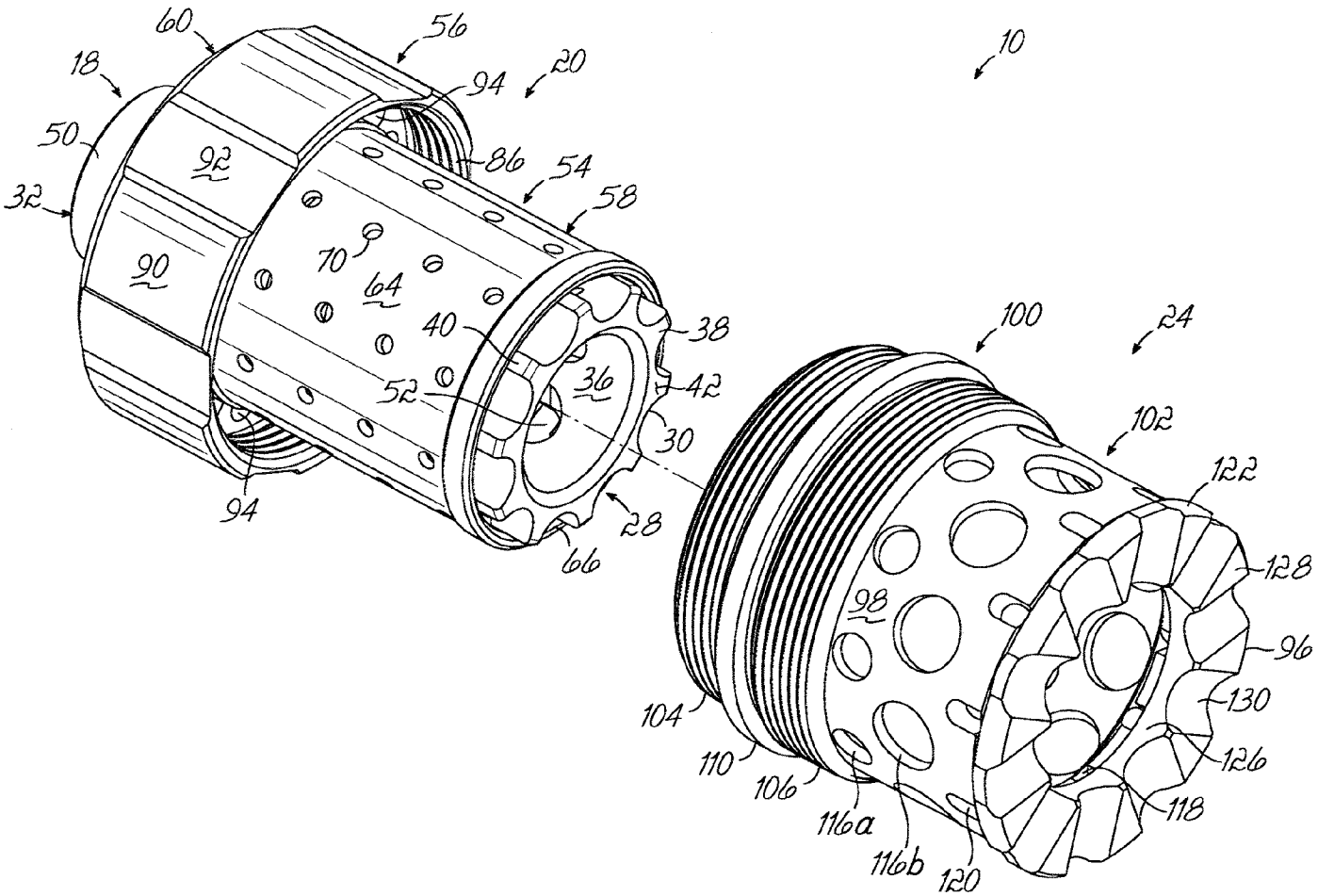
FIG. 7 is an exploded perspective view of the booster of FIGS. 3 and 6.

Also shown in FIGS. 4 and 5, the booster 10 separates the surfaces that abut the head portion 28 of the piston 18 and slidably guide the head portion 28 of the piston 18. More specifically, the head portion 28 of the piston 18 abuts the internal shoulder 26, which is on the housing 24, while the head portion 28 is guided along the first inner periphery 66 of the inner housing 64 of the cap assembly 20. Consequently, when the booster 10 is to be disassembled for cleaning or other purposes, the cap assembly 20 is unscrewed from the housing 24 and pulled away from the housing 24 along with the piston 18. The booster 10 is then in the configuration shown in FIGS. 6 and 7. As shown in FIGS. 6 and 7, the head portion 28 of the piston 18 is actually partially disposed outside the inner housing 64 when the housing 24 is disengaged from the cap assembly 20. To remove the piston 18 from the cap assembly 20, the head portion 28 of the piston 18 only needs to be pulled forward a small distance to exit the forward portion 54 of the cap assembly 20.

Furthermore, the piston 18 is removable from the booster 10 in a relative forward direction, which is also in the direction of the spring 22 bias. In this regard, the spring 22 may force the head portion 28 of the piston 18 out of the inner housing 64 immediately upon removal of the housing 24 from the cap assembly 20. In any event, the piston 18 will only need to be slid a very short distance while guided by the sliding engagement with the first inner periphery 66 of the inner housing 64. This configuration of the booster 10 substantially eliminates the difficulty of disassembling the booster 10 when the interior spaces and chambers are partially blocked with soot-like deposits and particulate matter on the first inner periphery 66 of the inner housing 64 released during repeated discharges of the firearm 16.

While the present invention has been illustrated by the description of the embodiment thereof, and while the embodiment has been described in considerable detail, it is not the intention of the applicant to restrict or in any way limit the scope of the appended claims to such detail. Additional advantages and modifications will readily appear to those skilled in the art. For example, the housing 24 could be coupled to the cap assembly 20 at the forward wall 96 and the inner housing 64 rather than adjacent to the rear portion 56 of the cap assembly 20. In this type of embodiment, the outer housing 98 would be removed and the cap assembly 20, but the booster 10 would still operate as previously described. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A recoil booster for use with a sound suppressor for a firearm, comprising:

a hollow piston having a head portion at a forward end defining a first outer periphery and an elongate generally cylindrical portion rearward of the head portion defining a second outer periphery, the piston configured to be coupled at a rearward end to a barrel of the firearm;

a cap assembly including a forward portion having a first inner periphery configured to slidably guide the first outer periphery of the head portion of the piston and further configured to be spaced from the second outer periphery of the cylindrical portion of the piston to define an annular space there between, the cap assembly also including a rear portion having a second inner periphery configured to slidably engage the second outer periphery of the cylindrical portion of the piston;

a spring disposed in the annular space between the head portion of the piston and the rear portion of the cap assembly, the spring biasing the head portion of the piston away from the rear portion of the cap assembly; and a housing coupled to the sound suppressor and removably coupled to the cap assembly, the housing including an internal shoulder configured to abut the head portion of the piston in a nominal position of the booster, wherein the piston may be removed from the booster by sliding forward out of the forward portion of the cap assembly with minimal sliding of the first outer periphery of the head portion along the first inner periphery of the cap assembly when the cap assembly is uncoupled from the housing.

2. The recoil booster of claim 1, wherein the housing is formed integrally with the sound suppressor.

3. The recoil booster of claim 1, wherein the piston further comprises a central bore and a plurality of slots at the cylindrical portion, the plurality of slots enabling fluid communication between the central bore and the annular space.

4. The recoil booster of claim 3, wherein the piston is threadably coupled to the barrel of the firearm, and wherein the each of the plurality of slots is cut at an angle from a radial direction such that pressurized gases flowing through the plurality of slots upon discharge of the firearm apply a force tending to tighten the threaded coupling of the piston and the barrel of the firearm.

5. The recoil booster of claim 1, wherein the head portion of the piston includes a plurality of spokes defining the first outer periphery.

6. The recoil booster of claim 5, wherein the internal shoulder of the housing includes a plurality of slots configured to receive the plurality of spokes when the head portion of the piston abuts the internal shoulder.

7. The recoil booster of claim 6, wherein the housing further includes a first plurality of radial apertures in communication with the plurality of slots.

8. The recoil booster of claim 1, wherein the housing further includes a forward wall defining the internal shoulder and a generally cylindrical outer housing extending rearward from the forward wall, the outer housing including first external threads configured to couple to the cap assembly adjacent to the rear portion of the cap assembly.

9. The recoil booster of claim 8, wherein the forward portion of the cap assembly includes an inner housing extending coaxial with the outer housing and from the rear portion of the cap assembly toward the forward wall of the housing, the inner housing and outer housing defining a first annular chamber there between.

10. The recoil booster of claim 9, wherein the inner housing of the cap assembly includes a plurality of apertures providing fluid communication between the annular space and the first annular chamber.

11. The recoil booster of claim 9, wherein the outer housing further includes second external threads configured to couple an outer tube of the sound suppressor to the housing, the outer tube of the sound suppressor and the outer housing defining a second annular chamber there between.

12. The recoil booster of claim 11, wherein the outer housing includes a second plurality of radial apertures between the forward wall and the second external threads, the second plurality of radial apertures providing fluid communication between the first annular chamber and the second annular chamber.

13. The recoil booster of claim 12, wherein the second plurality of radial apertures further includes a first circular series of large apertures and a second circular series of small apertures rearward of the first circular series of large apertures, the small apertures being smaller in diameter than the large apertures.

14. The recoil booster of claim 11, wherein the forward wall includes an outer periphery including a plurality of grooves, the grooves in fluid communication with the second annular chamber and an area of the sound suppressor forward of the housing.

15. The recoil booster of claim 9, wherein the cap assembly further comprises a first cap member defining the inner housing along the forward portion and having external threads along the rear portion, and a second cap member with first internal threads configured to couple to the first external threads of the outer housing and second internal threads configured to couple to the external threads of the first cap member.

16. The recoil booster of claim 15, wherein the second cap member includes a contoured outer peripheral surface configured to be gripped for rotating the cap assembly with respect to the housing.

17. The recoil booster of claim 15, wherein the first cap member includes an 0-ring along the second inner periphery configured to seal the internal space from a space external to the booster.

* * * * *